US006896510B2

(12) United States Patent
Matsuyama

(10) Patent No.: US 6,896,510 B2
(45) Date of Patent: May 24, 2005

(54) APPARATUS AND METHODS FOR CONTROLLING A FLAME

(76) Inventor: Susumu Matsuyama, 2005 Palmetto Dunes Ct., Duluth, GA (US) 30097

( * ) Notice: Subject to any disclaimer, the term of this patent is extended or adjusted under 35 U.S.C. 154(b) by 130 days.

(21) Appl. No.: 10/336,316

(22) Filed: Jan. 3, 2003

(65) Prior Publication Data

US 2003/0211434 A1 Nov. 13, 2003

Related U.S. Application Data

(60) Provisional application No. 60/379,031, filed on May 8, 2002.

(51) Int. Cl.[7] ..... F23D 3/18

(52) U.S. Cl. ..... 431/284; 431/299; 431/302; 431/309; 431/314; 431/321; 431/323

(58) Field of Search ..... 431/278, 282, 431/284, 299, 302, 309, 314, 323, 344, 321; 126/96, 97

(56) References Cited

U.S. PATENT DOCUMENTS

| | | | | | |
|---|---|---|---|---|---|
| 32,721 | A | * | 7/1861 | Russell | 431/302 |
| 108,416 | A | * | 10/1870 | Washington | 431/321 |
| 193,525 | A | | 7/1877 | Lewars et al. | |
| 193,673 | A | | 7/1877 | Rhind | |
| 213,052 | A | | 3/1879 | Lubin | |
| 241,298 | A | | 5/1881 | Carnahan | |
| 9,843 | A | | 8/1881 | Woods et al. | |
| 356,480 | A | * | 1/1887 | Lavercombe | 431/309 |
| 403,151 | A | | 5/1889 | Siemang et al. | |
| 429,908 | A | | 6/1890 | Heal | |
| 454,686 | A | * | 6/1891 | Richmond | 431/308 |
| 467,736 | A | | 1/1892 | Fernelmont et al. | |
| 585,822 | A | | 7/1897 | Larwill et al. | |
| 643,097 | A | * | 2/1900 | Adam | 431/299 |
| 959,804 | A | | 5/1910 | Purdy | |
| 1,037,948 | A | | 9/1912 | Mangin | |
| 1,412,704 | A | * | 4/1922 | Osborne | 431/316 |
| 2,430,323 | A | * | 11/1947 | Joseph | 431/276 |
| 3,279,222 | A | | 10/1966 | Hebard | 67/81 |
| 3,516,774 | A | | 6/1970 | Livingstone | 431/323 |
| 4,610,239 | A | | 9/1986 | Nakamura et al. | 126/96 |

* cited by examiner

*Primary Examiner*—Ira S. Lazarus
*Assistant Examiner*—James G. Barrow
(74) *Attorney, Agent, or Firm*—Thomas, Kayden, Horstemeyer & Risley, LLP

(57) ABSTRACT

An apparatus for producing a sustained flame, comprising: a first reservoir for containing a first flame-fueling liquid; a second reservoir for containing a second flame-fueling liquid; a first wick having a first end disposed within the first reservoir and a second, flame-bearing end generally located above the first end; a second wick disposed substantially adjacent to the first wick, having a first end disposed within the second reservoir and a second, flame-bearing end above the first end; and at least one air channel disposed to supply oxygen to each wick, where a first end of the at least one air channel is generally located near the flame-bearing end of each wick; whereby, when the first and second flame-fueling liquids are supplied to the first and second reservoirs, the first and second flame-fueling liquids are communicated up the first and second wicks to fuel flames emanating from the flame-bearing ends of the first and second wicks.

A method for controlling a flame comprising: controlling a first flow of air to a first flame; controlling a second flow of air to a second flame; wherein the first flame and the second flame are concentrically disposed.

18 Claims, 5 Drawing Sheets

APPARATUS AND METHODS FOR CONTROLLING A FLAME

CROSS-REFERENCE TO RELATED APPLICATION

This application claims priority to copending U.S. provisional application entitled, "Systems and Methods for Controlling Characteristics of a Flame," having Ser. No. 60/379,031, filed May 8, 2002, which is entirely incorporated herein by reference.

FIELD OF THE INVENTION

The present invention relates to apparatus and methods for controlling a flame.

BACKGROUND

Some fuels burned by oil lamps produce relatively large amounts of smoke, but are still in use because they have other beneficial properties. For example, citronella oil produces smoke but is useful for repelling insects, such as mosquitoes. Although a citronella lamp user can avoid the buildup of smoke by extinguishing the lamp and relighting it later, this is undesirable because it extinguishes the light source. Although the amount of light produced by citronella oil is less than other types of liquid fuels, it is nonetheless convenient to have this light source and many users find the pink colored flame to be attractive.

Air drafts around the flame tend to increase the amount of smoke produced, so some existing lamps provide a shield around the flame to protect from drafts. However, shielding the flame from drafts can result in an inadequate air supply to the flame. This inadequate air supply results in incomplete combustion, which also tends to increase the amount of smoke produced.

SUMMARY

The present invention is directed to unique methods and apparatus for controlling a flame. In one embodiment, independent control of the characteristics of an inner flame and an outer flame is provided by controlling the flow of fuel and air to the flames. The apparatus and method reduces smoke by providing a stable airflow to the flames, thus reducing the effect of air drifting over the flames. The outer flame also reduces smoke by burning soot particles produced by the inner flame, and by shielding the inner flame from outside air. These features are especially useful when the fuel is citronella oil, which produces a relatively smoky flame. However, these apparatuses and methods apply to various types of liquid fuel, and are not limited to any particular type of liquid fuel such as citronella.

The size of the inner and outer flames can be independently controlled by controlling the flow of air and fuel to the flames. In one embodiment, the inner flame can be extinguished by closing off the fuel supply, then can be reignited by reopening the fuel supply. Using different types of fuels for the two flames results in different colors for the inner and outer flames, which provides a visually appealing effect. For example, using citronella oil for the inner flame and liquid paraffin oil for the outer flame results in an inner flame which is of a generally pink color, and an outer flame which is of a generally yellow color. Color characteristics are further controlled by reducing the airflow between the inner and outer flames, which may provide a single flame with a blend of colors from the two fuels.

DESCRIPTION OF THE DRAWINGS

In the drawings, individual components of the apparatus are not necessarily drawn to scale, or with the same proportions.

DETAILED DESCRIPTION

Figure 1:
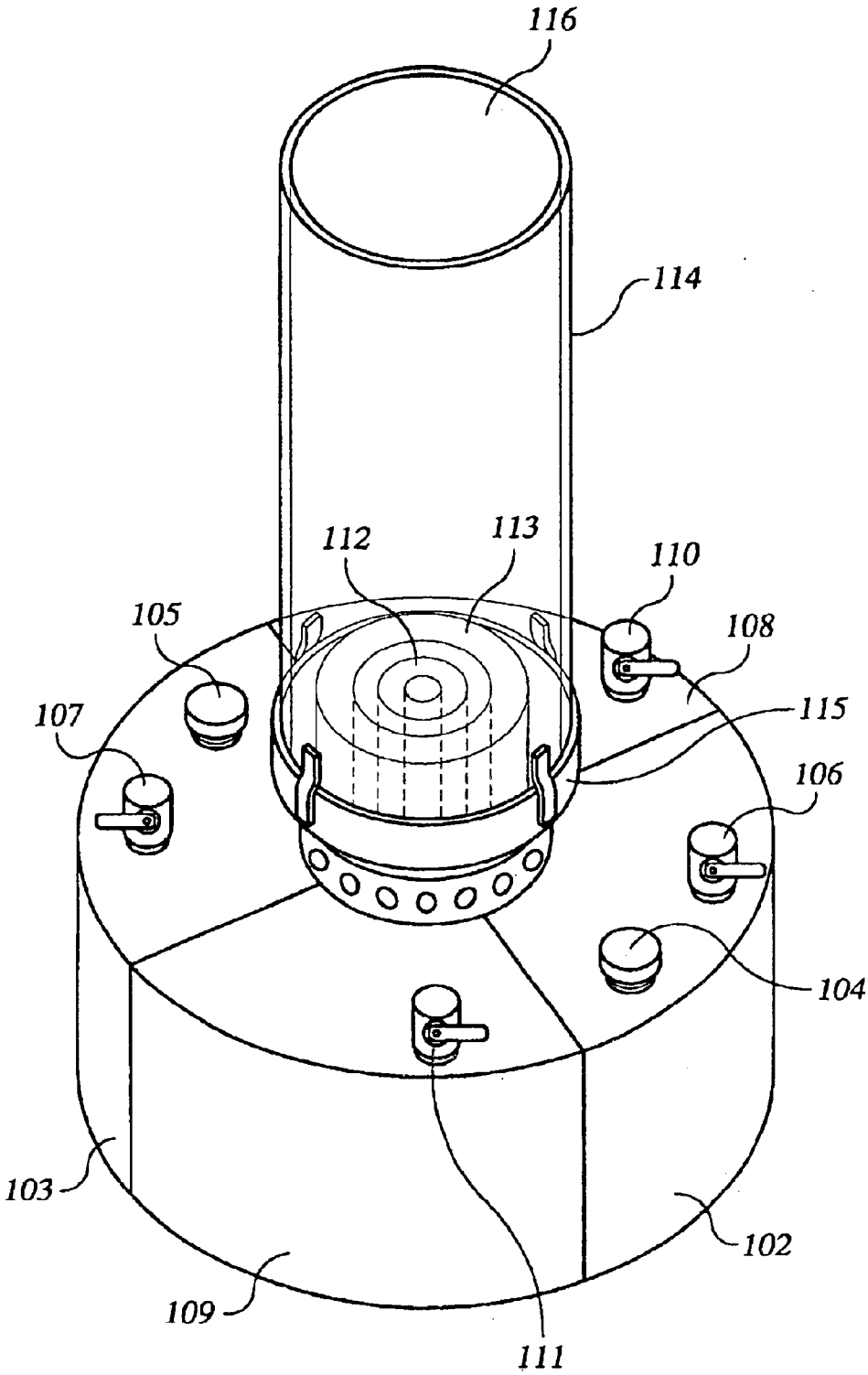
FIG. 1 is a perspective view of an exemplary embodiment of an apparatus for controlling a flame.

FIG. 1 is a perspective view of an exemplary embodiment of an apparatus for controlling a flame. The apparatus includes: fuel reservoirs 102 and 103; caps 104 and 105; fuel valves 106 and 107; air containers 108 and 109; air valves 110 and 111; wicks 112 and 113; shield 114; and collar 115.

The fuel reservoirs 102, 103 contain liquid fuel, for example, liquid paraffin, mineral oil, citronella oil, or a variety of other suitable fuels. In one embodiment, the fuels contained in fuel reservoirs 102, 103 are different, so that the color characteristics of the flames may be different. Caps 104, 105 allow the fuel reservoirs 102, 103 to be filled, and also seal to prevent air from entering fuel reservoirs 102, 103 through the cap opening. In one embodiment, caps 104, 105 are safety caps to prevent buildup of excess vapor pressure. Each fuel valve 106, 107 is in fluid communication with one of the fuel reservoirs 102, 103, so that when fuel valve 106, 107 is open, ambient air flows into fuel reservoir 102, 103.

Each fuel reservoir 102, 103 is in liquid communication with one of the wicks 112, 113. The wicks 112, 113 may be made of any suitable material, such as glass fiber or metal mesh, as long as the wick draws liquid fuel from the fuel reservoir.

Each air valve 110, 111 is in fluid communication with an air container 108, 109, so that when air valve 110, 111 is open, atmospheric air flows into air container 108, 109.

Air flows from air container 108, 109 to the flame-bearing end of a corresponding wick 112, 113. Supplying air through a container provides a regulated and continuous flow of air to the flame, reducing the effect of any air currents or turbulence around the apparatus.

The exemplary embodiment may also include a shield 114 surrounding wicks 112, 113, and a collar 115, which fastens shield 114 to the fuel reservoirs 102, 103 and/or air containers 108, 109. Shield 114 acts to prevent a user from coming into direct contact with the flame, and also to prevent air drafts from affecting the flame. Shield 114 has an aperture 116 to allow exhaust gases to escape from the apparatus. The aperture of a conventional lamp must be relatively large in order to provide an adequate air supply to the flame, but aperture 116 can be relatively small because the apparatus supplies air to the vicinity of the flame through an air channel (see FIG. 2). A small aperture may be desired because it prevents air drafts from extinguishing the flame.

Figure 2:
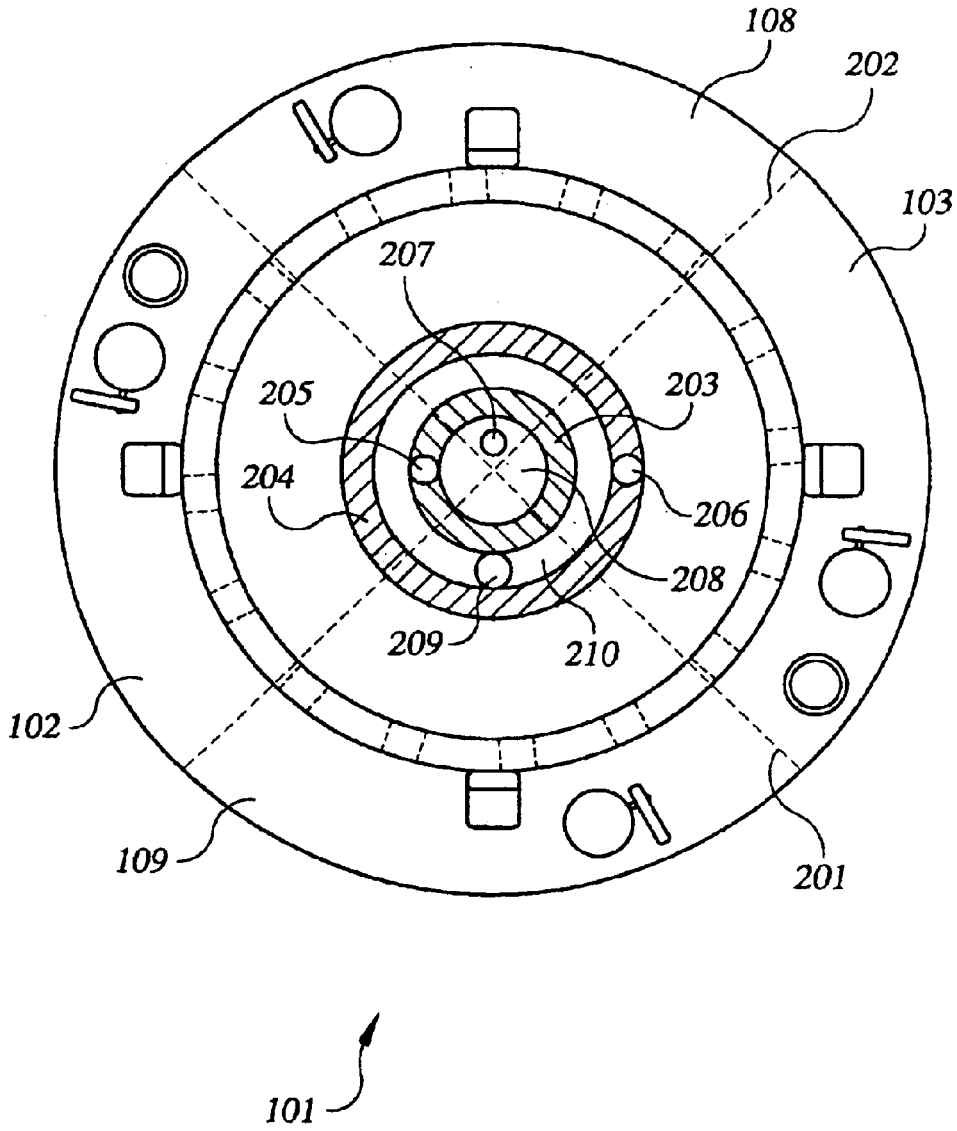
FIG. 2 is a top sectional view of the apparatus of FIG. 1.

FIG. 2 is a top sectional view of the apparatus of FIG. 1. In one embodiment, fuel reservoirs 102 and 103 and air containers 108 and 109 are separate pie-shaped pieces arranged to form a substantially circular base 101. In an alternative embodiment, fuel reservoirs 102 and 103 and air containers 108 and 109 are instead portions of substantially circular base 101, formed by separation walls 201 and 202 inside one-piece base 101.

In this exemplary embodiment, wicks 112, 113 (see FIG. 2) are concentrically disposed atop the base 101 at wick receiving areas 203 and 204, respectively. The wicks can be made of, for example, a tubular form of cotton/glass fiber. A portion of each wick 112, 113 is in fluid communication with fuel reservoirs 102, 103 through openings 205, 206 in fuel reservoirs 102, 103. Wick 112 is supplied with air from air container 108, through opening 207 in air container 108, which opens into air channel 208 in the hollow center of the first wick 112. Wick 113 is supplied with air from air container 109, through opening 209 in air container 109, which opens to air channel 210 in the space between the inner and outer wicks 112 and 113.

Figure 3:
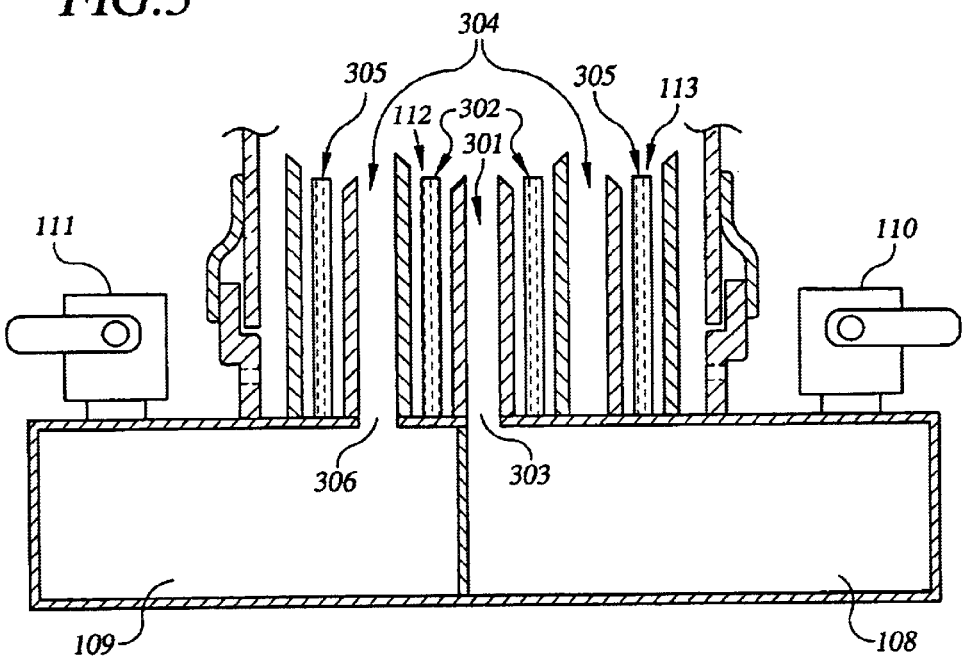
FIG. 3 is a partial side cutaway view of the apparatus of FIG. 1.

FIG. 3 is a partial side cutaway view of the apparatus of FIG. 1. In this view, air containers 108, 109 are visible, but fuel reservoirs 102, 103 are not. Air channel 208 (FIG. 2) has a first end 301 located near the flame-bearing end 302 of wick 112, and a second end 303 located in air container 108. Air channel 210 (FIG. 2) has a first end 304 located near the flame-bearing end 305 of wick 113, and a second end 306 located in air container 109.

When air is allowed to flow freely through air channels 208 and 210, each of the wicks 112, 113 produces a distinct and separate flame at its flame-bearing ends 302, 305. Flames with different characteristics can be produced by using different fuels in fuel reservoirs 102, 103. One characteristic that varies with the type of fuel is the flame color: liquid paraffin produces a yellow flame; citronella oil produces pink; oil blended with copper salts produces green or blue; oil blended with lithium salts produces red. These flame colors can be manipulated by controlling the flow of air through air channels 208 and 210.

When airflow through air channel 208 to center of wick 112 is reduced, the color of the flame on wicks 112 and 113 is unaffected, but the size of the flame on wick 112 is decreased. When airflow through air channel 210 to the area between wicks 112 and 113 is reduced, the inner flame on wick 112 is unaffected, but the outer flame on wick 113 migrates from the outer edge of the wick and begins to merge with the inner flame on wick 112. As airflow through air channel 210 decreases further, the flame-bearing end 305 of wick stops burning, though the area in between wicks 112 and 113 still contains hot gases which are a product of fuels from both fuel reservoirs 102, 103. At this point, the inner flame on wick 112 is of a single color but the color of the merged flame in the area surrounding the inner flame is a blend of colors, a result of the mixture of fuels in this area.

In the embodiment illustrated in FIG. 3, the airflow through air channels 208 and 210 is reduced using air valves 110 and 111. However, other mechanisms may be used to control airflow.

Figure 4:
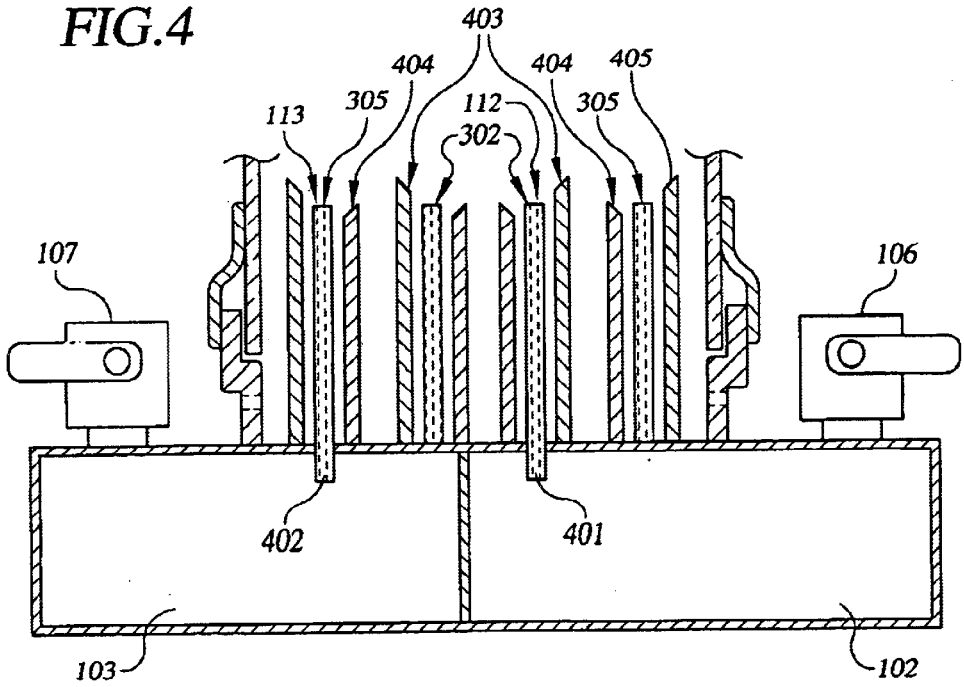
FIG. 4 is a partial front cutaway view of the apparatus of FIG. 1.

FIG. 4 is a partial front cutaway view, of the apparatus of FIG. 1. In this view, fuel reservoirs 102, 103 are visible, but air containers 108, 109 are not. A portion of wick 112, comprising a second end 401, extends into fuel reservoir 102. Similarly, a portion of wick 113, comprising second end 402, extends into fuel reservoir 103. Fuel valves 106, 107 control the flow of air from the atmosphere into fuel reservoirs 102, 103.

The fuel flows generally as follows: wicks 112, 113 utilize the surface tension of the liquid fuel to draw it up through the fibers of the wick by capillary action. When the wick 112, 113 burns fuel at its flame bearing end 302, 305, an equal amount is drawn up the wick 112, 113 from fuel reservoir 102, 103 to replenish the burned fuel. In normal operation, fuel valves 106, 107 are open, so that air flows from the atmosphere into fuel reservoir 102, 103 to fill the void left by the burned fuel.

In another mode of operation, fuel valves 106, 107 are closed so that air is unable to flow into fuel reservoir 102, 103 to fill the void left by the burned fuel. In this mode, the internal pressure in fuel reservoir 102, 103 is reduced as the fuel burns. This reduced internal pressure resists the capillary action of the wick. When the reduced internal pressure is great enough to overcome the capillary action, liquid fuel is no longer drawn up the wick 112, 113 to replenish the burned fuel. At this point, the flame will diminish in size as the fuel already in the wick is burned, until that fuel runs out and the flame is finally extinguished. Thus, closing fuel valve 106 on fuel reservoir 102 will result in the flame of wick 112 being extinguished, while closing fuel valve 107 on fuel reservoir 103 will result in the flame of wick 113 being extinguished. If fuel valve 106 or 107 is reopened, then the corresponding wick will reignite after a period of time, unless both fuel valves 106 and 107 have been closed.

In the exemplary embodiment illustrated in FIG. 4, the apparatus also includes wick sleeves 403, 404 to carry wicks 112, 113. In one embodiment, the wick sleeves 403, 404 are shaped to closely conform to the wicks 112, 113. Wick sleeves 403, 404 prevent expansion of the flame to the lower part of the wicks 112, 113, and increase the capillary pressure on wicks 112, 113. Wick sleeves 403, 404 may be made of a heat-conductive material, for example, copper or glass, to lower the viscosity of the liquid fuel. In one embodiment, the wick sleeves 403, 404 are made of glass tubing and have an angled edge 405 at the end corresponding to the flame-bearing end 302, 305 of the wick. This angled edge 405 aids in the insertion and removal of the wick 112, 113, and also reduces flow of liquid fuel down the side of wick sleeves 403, 404 and into air containers 108, 109.

Figure 5:
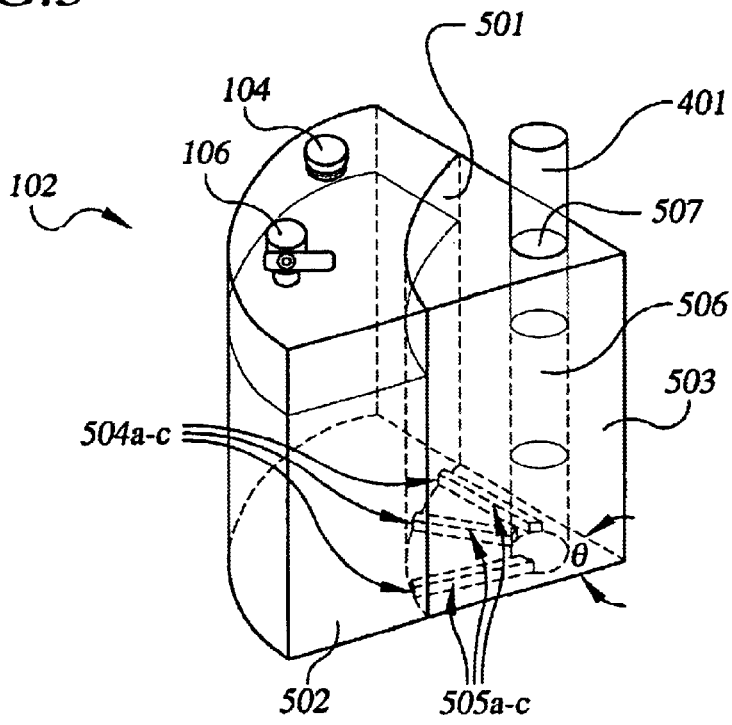
FIG. 5 is a cutaway view of the fuel reservoir section of FIG. 1.

FIG. 5 is a cutaway view of the fuel reservoir section of FIG. 1. The angle θ can be varied to produce reservoirs of various number and capacities. Wall 501 divides fuel reservoir 102 into a first portion 502 and a second portion 503. The fuel reservoir 102 is fillable with liquid fuel through cap 104, which is in fluid communication with first portion 502. Fuel valve 106, also in fluid communication with first portion 502, controls the flow of air from the atmosphere into fuel reservoir 102, as described with regard to FIG. 4. At least one perforation 504*a–c* in wall 501 allows fuel to communicate between first portion 502 and second portion 503. The fuel end 401 of the wick 112 is located in second portion 503, such that it makes contact with liquid fuel flowing into second portion 503.

In the exemplary embodiment, first portion 502 is hollow, and second portion 503 is solid, except for at least one first channel 505*a–c* and a second channel 506 connecting to first channels 505*a–c*. Use of a solid central portion strengthens the base 101 (see FIG.2). The open end 507 of second channel 506 lines up with opening 205 (see FIG. 2) in the base 101.

First channels 505*a–c* are aligned with perforations 504*a–c* so that liquid fuel contained in first portion 502 flows through perforations 504*a–c* into first channels 505*a–c*, and from there flows into second channel 506. Perforations 504*a–c* provide an air-tight seal around first channels 505*a–c*. The fuel end 401 of the wick 112 is located in second channel 506 such that it makes contact with liquid fuel flowing into second channel 506. In this embodiment, first channels 505*a–c* are substantially aligned along a horizontal axis and second channel 506 is substantially aligned along a vertical axis, but embodiments can include any alignment that allows the liquid fuel to flow from first portion 502 into second channel 506.

Figure 6:
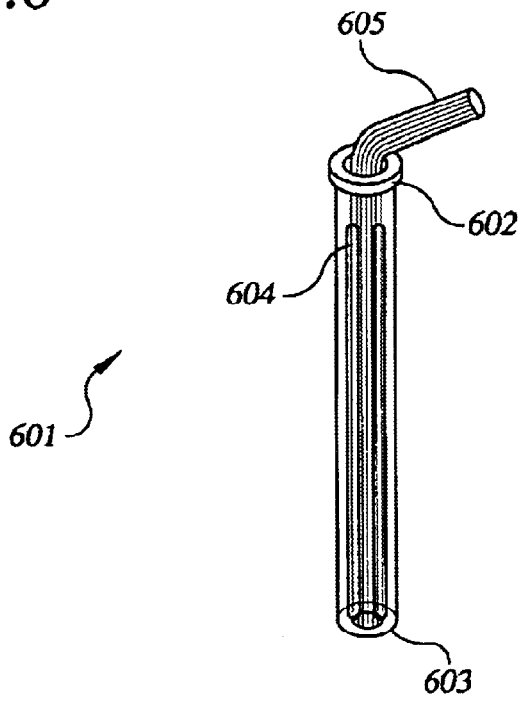
FIG. 6 illustrates a wick holder which can be used in conjunction with an embodiment of an apparatus for controlling a flame.

FIG. 6 illustrates a wick holder 601 which can be used in conjunction with the fuel reservoir illustrated in FIG. 5. In this embodiment, wick holder 601 fits into second channel 506 (see FIG. 5). Wick holder 601 is tubular, with an open end 602 which aligns with hole 205 (see FIG. 2) when placed in second channel 506 (see FIG. 5) and a closed end 603. At least one slit 604 in wick holder 601 allows liquid fuel to flow from vertical channel 506 (see FIG. 5) into fuel end 401 (see FIG. 4) of wick 112 (see FIG. 4), and from there liquid fuel travels to flame bearing end 302 (see FIG. 4) via capillary action. Wick holder 601 can be made of any suitable material such as metal or glass.

Figure 7:
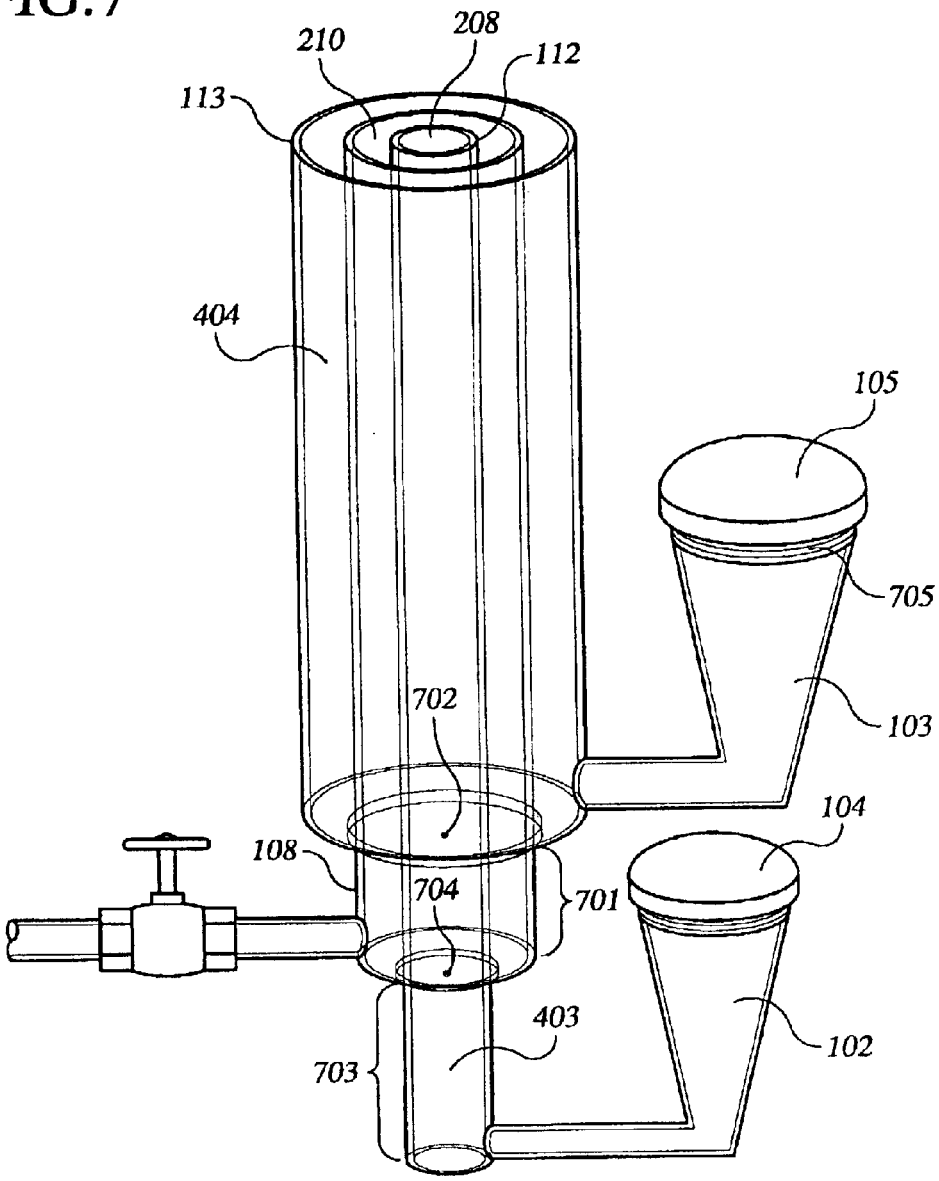
FIG. 7 is a perspective view of another embodiment of an apparatus for controlling a flame.

FIG. 7 is a perspective view of another embodiment of an apparatus for controlling a flame. Inner wick 112 and outer wick 113 are concentrically arranged, with an air channel 210 disposed between them. An additional air channel 208 is disposed in the approximate center of the inner wick 112. An inner wick sleeve 403 surrounds one surface of inner wick 112. An outer wick sleeve 404 surrounds one surface of outer wick 113. Fuel reservoirs 102, 103 are in fluid communication wicks 112 and 113.

In the example embodiment, the apparatus consists of several nested pieces. Wick sleeves 403 and 404 are substantially tubular in shape, and wicks 112 and 113 are shaped like hollow cylinders. Another tubular piece, air container 108, is disposed between outer wick 112 and inner wick 113, forming air channel 210 between the wall of air container 108 and the outer surface of inner wick 112.

In the example embodiment, wick sleeves 403, 404 and air container 108 are each of different lengths. The length of air container 108 is such that when air container is placed inside outer wick sleeve 404 and their tops are substantially aligned, a portion 701 of air container 108 extends through opening 702 in outer wick sleeve 404. Similarly, the length of inner wick sleeve 403 is such that when inner wick sleeve 403 is placed inside air container 108 and their tops are substantially aligned, a portion 703 of inner wick sleeve 403 extends through opening 704 in air container 108.

Fuel reservoirs 102, 103 are in fluid communication with wick sleeves 403, 404. In the exemplary embodiment, fuel reservoirs 102, 103 are an integrated part of wick sleeves 403, 404, but in another embodiment fuel reservoirs 102 and 103 are separate pieces connected to wick sleeves 403, 404. Caps 104, 105 allow fuel reservoirs 102, 103 to be filled.

In addition, threads 705 on the exemplary embodiment allow caps 104, 105 to regulate the flow of air into fuel reservoirs 102, 103. When cap 104, 105 is in a tightly closed position, the pressure inside fuel reservoir 102, 103 is reduced as fuel is burned, and this reduced pressure resists the capillary action of wick 112, 113, so that finally the wick stops drawing fuel and the flame is extinguished. When cap 104, 105 is not tightly closed, air flows into fuel reservoir 102, 103 as fuel is burned so that pressure is not reduced and the capillary action of wick 112, 113 continues. While threads 705 in cap 104, 105 are used in the exemplary embodiment, any mechanism which regulates the flow of air into fuel reservoirs 102, 103 could be used instead.

The foregoing description has been presented for purposes of illustration and description. It is not intended to be exhaustive or to limit the invention to the precise forms disclosed. Obvious modifications or variations are possible in light of the above teachings. The embodiments discussed, however, were chosen and described to illustrate the principles of the invention and its practical application to thereby enable one of ordinary skill in the art to utilize the invention in various embodiments and with various modifications as are suited to the particular use contemplated. All such modifications and variation are within the scope of the invention as determined by the appended claims when interpreted in accordance with the breadth to which they are fairly and legally entitled.

What is claimed is:

1. An apparatus for producing a sustained flame comprising:

a first reservoir for containing a first flame-fueling liquid;

a second reservoir for containing a second flame-fueling liquid;

a first wick having a first end disposed within the first reservoir and a second, flame-bearing end generally located above the first end;

a second wick disposed substantially adjacent the first wick, having a first end disposed within the second reservoir and a second, flame-bearing end above the first end; and at least one air channel disposed to supply oxygen to each wick, where a first end of the at least one air channel is generally located near the flame-bearing end of each wick;

whereby, when the first and second flame-fueling liquids are supplied to the first and second reservoirs, the first and second flame-fueling liquids are communicated up the first and second wicks to fuel flames emanating from the flame-bearing ends of the first and second wicks, wherein the first and second wicks are concentrically disposed, wherein the first and second wicks are shaped in the form of hollow cylinders.

2. The apparatus of claim 1, wherein the first wick is centrally disposed and the second wick is coaxially aligned with the first wick.

3. The apparatus of claim 2, wherein the first end of the first air channel is generally disposed within the center of the first wick and the first end of a second air channel is located between the first wick and the second wick.

4. The apparatus of claim 1, wherein the at least one air channel is tubular.

5. The apparatus of claim 1, further comprising:

a first wick sleeve to carry the first wick; and a second wick sleeve to carry the second wick.

6. The apparatus of claim 5, wherein the first wick sleeve closely conforms to the first wick and the second wick sleeve closely conforms to the second wick.

7. An apparatus for producing a sustained flame comprising:

a first reservoir for containing a first flame-fueling liquid;

a second reservoir for containing a second flame-fueling liquid;

a first wick having a first end disposed within the first reservoir and a second, flame-bearing end generally located above the first end;

a second wick disposed substantially adjacent the first wick, having a first end disposed within the second reservoir and a second, flame-bearing end above the first end;

a first air channel disposed to supply oxygen to each wick, where a first end of the first air channel is generally located near the flame-bearing end of each wick; and a valve for controlling flow of air into the at least one air channel, whereby, when the first and second flame-fueling liquids are supplied to the first and second reservoirs, the first and second flame-fueling liquids are communicated up the first and second wicks to fuel flames emanating from the flame-bearing ends of the first and second wicks.

8. The apparatus of claim 7, further comprising:

an air container, where a second end of the air channel connects to the air container, and where the valve is in fluid communication with the air container.

9. The apparatus of claim 7, wherein the first end of the first air channel is generally disposed within the center of the first wick and the first end of a second air channel is located between the first wick and the second wick.

10. The apparatus of claim 7, further comprising:

a first wick sleeve to carry the first wick; and a second wick sleeve to carry the second wick.

11. The apparatus of claim 10, wherein the first wick sleeve closely conforms to the first wick and the second wick sleeve closely conforms to the second wick.

12. An apparatus for producing a sustained flame comprising:

a first reservoir for containing a first flame-fueling liquid, wherein the first reservoir further comprises:

a cap which forms airtight seal; and a valve for controlling a flow of air into the first reservior;

a second reservior for containing a second flame-fueling liquid;

a first wick having a first end disposed within the first reservior and a second, flame-bearing end generally located above the first end;

a second wick disposed substantially adjacent the first wick, having a first end disposed within the second reservoir and a second, flame-bearing end above the first end; and a first air channel disposed to supply oxygen to each wick, where a first end of the first air channel is generally located near the flame-bearing end of each wick;

whereby, when the first and second flame-fueling liquids are supplied to the first and second reservoirs, the first and second flame-fueling liquids are communicated up the first and second wicks to fuel flames emanating from the flame-bearing ends of the first and second wicks.

13. The apparatus of claim 12, wherein the first reservoir further comprises:

a separation wall which divides the first reservoir into a first portion and a second portion; where the valve and the cap are generally disposed in fluid communication with the first portion, the first end of the first wick is generally disposed in fluid communication with the second portion, and at least one perforation in the separation wall which allows the fuel in the first portion to communicate with the wick in the second portion.

14. The apparatus of claim 12, further comprising:

a wick holder generally disposed within the first portion.

15. The apparatus of claim 13, wherein the wick holder is tubular with at least one slot along its longitudinal axis and with a closed end.

16. The apparatus of claim 12, wherein the first end of the first air channel is generally disposed within the center of the first wick and the first end of a second air channel is located between the first wick and the second wick.

17. The apparatus of claim 12, further comprising:

a first wick sleeve to carry the first wick; and a second wick sleeve to carry the second wick.

18. The apparatus of claim 17, wherein the first wick sleeve closely conforms to the first wick and the second wick sleeve closely conforms to the second wick.

* * * * *